United States Patent [19]

Rauch et al.

[11] 4,255,215

[45] Mar. 10, 1981

[54] ORIENTED LOW-ALLOY IRON CONTAINING CRITICAL AMOUNTS OF SILICON AND CHROMIUM

[75] Inventors: Gary C. Rauch, Murrysville; Donald R. Thornburg; Karl Foster, both of Forest Hills, all of Pa.

[73] Assignee: Westinghouse Electric Corp., Pittsburgh, Pa.

[21] Appl. No.: 38,361

[22] Filed: May 11, 1979

[51] Int. Cl.[3] ..... H01F 1/04

[52] U.S. Cl. ..... 148/31.55; 75/126 R; 75/123 L; 148/111

[58] Field of Search ..... 75/126 R, 123 L; 148/31.55, 110, 111, 112, 120

[56] References Cited

U.S. PATENT DOCUMENTS

| | | | |
|---|---|---|---|
| 436,497 | 9/1890 | Hadfield et al. | 75/126 R |
| 3,368,887 | 2/1968 | Enis et al. | 75/126 R |
| 3,849,212 | 11/1974 | Thornburg | 148/31.55 |
| 3,881,967 | 5/1975 | Cochardt et al. | 148/31.55 |
| 3,892,604 | 7/1975 | Thornburg | 148/120 |
| 3,892,605 | 7/1975 | Thornburg | 148/31.55 |

OTHER PUBLICATIONS

"Development of (110) [001] Texture in Low-Alloy Iron by Primary Recrystallization and Normal Grain Growth", vol. 8A, Jan. 1977, Metallurgical Trans.

"Magnetic Properties of (110) [001] Oriented Low-Alloy Iron " American Institute of Physics Conference Proceedings-21st Annual Conference, Phila. 1975.

*Primary Examiner*—L. Dewayne Rutledge
*Assistant Examiner*—John P. Sheehan
*Attorney, Agent, or Firm*—R. A. Stoltz

[57] ABSTRACT

This is a low-alloy iron having desirable magnetic characteristics suitable for electrical applications such as transformer cores. This material has improved texture and reduced core losses. The alloys contain 0.6–1.0% silicon and 0.4–0.8% chromium along with controlled levels of manganese, sulfur, carbon and oxygen. These alloys are preferably processed to about 0.006 inch (0.015 cm) final gauge using schedules with three cold-rolling steps. $B_{10}$ values above 19 kG and 17 kG losses below 0.72 watts per pound are obtained with these alloys.

2 Claims, No Drawings

ORIENTED LOW-ALLOY IRON CONTAINING CRITICAL AMOUNTS OF SILICON AND CHROMIUM

CROSS REFERENCE TO RELATED APPLICATIONS

A processing method and intermediate product alloy for oriented low-alloy iron is described in related application Ser. No. 038,360 filed concurrently by the same inventors and assigned to the same assignee. This related application has a critical level of sulfur, oxygen, and carbon but can contain relatively broad ranges of silicon and chromium. The method of this related application can, but need not necessarily be, used in conjunction with the compositions described herein.

An oriented-low-alloy iron with high initial sulfur content is described in related application Ser. No. 038,359 filed concurrently by the same inventors and assigned to the same assignee. This related application utilizes high ingot sulfur levels (0.012–0.020 percent) and is substantially free of manganese. Such higher sulfur content reduces melting cost, but requires an extensive final anneal.

BACKGROUND OF THE INVENTION

This invention relates to an iron based alloy having an oriented grain structure which is characterized by a cube-on-edge orientation (described in Miller indices as (110) [001] grain orientation), and having a primary recrystallized and normal grain growth microstructure. Such magnetic materials are useful, for example, as core materials in power and distribution transformers.

The operating inductions of a large portion of today's transformers are limited by the saturation value of the magnetic sheet material which forms the core. In extensive use today is an iron-based alloy containing nominally 3.25 percent silicon (all composition percentages herein are in weight percent) which is processed in order to obtain cube-on-edge or (110) [001] grain orientation in the final product. A well-known example of this type of steel called type M-5. These 3.25 percent silicon steels have the final grain orientation developed by means of a secondary recrystallized microstructure. This microstructure is attained during the final box annealing in which preferentially oriented grains grow at the expense of non-preferentially oriented grains with the result that the alloy usually has an extremely large grain structure size in which the diameter usually greatly exceeds the thickness of the sheet material. Obtaining such large grains in a secondarily recrystallized microstructure requires a long time, high temperature anneal for the development of the orientation. The extensive anneal is generally also required for the reduction of residual sulfur content. Sulfur contents in excess of about 100 ppm in the finished product adversely affect the magnetic characteristics exhibited by the silicon-iron alloy.

In addition to the costly long time, high temperature anneal, the addition of 3.25 percent silicon to pure iron, while effective and generally desirable for improving the volume resistivity, nevertheless lowers the saturation value in most commercially produced 3.25% silicon containing iron alloys to generally less than 20,300 gauss. Thus, there is the obvious trade-off as the improved resistivity (which lowers core losses of the material) is obtained at the expense of saturation value (significantly lower than the saturation value of about 21,500 gauss of commercially pure iron). Moreover, since commercial iron has substantially higher core losses and substantially higher coercive force values than silicon steel, it was prudent to balance the overall magnetic characteristics and the best balance heretofore obtained was that of the 3.25-percent-silicon iron alloy which exhibited the cube-on-edge orientation.

A primary recrystallized alloy alternative to the generally used commercial alloy is described in U.S. Pat No. 3,849,212, issued Nov. 19, 1974, and the associated primary recrystallization method is described in U.S. Pat. No. 3,892,605, issued July 1, 1975 (both to Thornburg). These relate to an iron base alloy made from an ingot containing up to about 0.03 percent carbon, up to 1 percent manganese, from about 0.3 to about 4 percent of at least one of the volume resistivity improving elements selected from the group consisting of up to about 2 percent silicon, up to 2 percent chromium, and up to about 3 percent cobalt. The balance of the alloy is essentially iron with incidental impurities. Thornburg's method utilizes processing by hot working and either a two- or three-stage cold rolling operation, with the final cold rolling stage working effecting only a moderate (50–75 percent) reduction in the cross sectional area of the material being processed. These prior patents deal in relatively broad ranges of composition and do not recognize the criticality between constituents.

SUMMARY OF THE INVENTION

This is a composition of an oriented low-alloy iron having improved texture and reduced core losses. This is a primary (as opposed to secondary) recrystallized material and contains 0.6–1.0% silicon and 0.4–0.8% chromium. The material also contains up to 1% manganese and up to 3% cobalt. After final anneal, the alloy may also contain up to 0.005% sulfur, up to 0.001% carbon and up to about 0.01% oxygen. Preferably the alloys are processed to a final gauge of about 0.006 inches (0.015 centimeters) and provides a material having $B_{10}$ values above 19 kilogauss and loss values at 17 kG of below 0.72 watts per pound.

DESCRIPTION OF THE PREFERRED EMBODIMENT

The aforementioned U.S. Pat. No. 3,849,212 describes strong (110) [001] textures in iron-based alloys with a variety of silicon and chromium levels. It has subsequently been discovered that optimum narrow ranges of silicon and chromium are critical in providing significantly improved texture and reduced core losses.

Although these alloys can be processed in a variety of manners, the following process was found to give very good results and was used in the experiments described herein. The material was hot rolled at 1050° C. to a thickness of 0.180 inches, cleaned, annealed at 850° C. for five hours in dry hydrogen, cold rolled to 0.080 inches, annealed at 850° C. for five hours in dry hydrogen, cold rolled to 0.020 inches, annealed at 850° C. for one hour in dry hydrogen, cold rolled to 0.006 inches, and final annealed for 48 hours at 900° C. in dry hydrogen (with a 50° C. per hour heating and cooling rate). While the oxygen levels normally do not change drastically during processing, the carbon and sulfur levels drop (carbon from 0.03% maximum in the ingot to 0.001% maximum after final annealing and sulfur from 0.012% maximum in the ingot to 0.005% maximum after final annealing).

Table 1, below, shows the results of measurements on annealed 0.006 inch Epstein samples for a variety of alloys similar to, but outside the critical ranges of silicon and chromium described herein. The measurements include the $H_c$ in Oe (coersive force in Oersteds), $B_{10}$ values in kG (Induction in a 10 Oersted field) and $P_c$ values in W/lb. (core loss at 60 hertz in watts per pound) at both 15 and 17 kilogauss.

TABLE 1

| Alloy No. | % Si | % Cr | $H_c$ (Oe) | $B_{10}$ (kG) | $B_{10}/B_s$ | $P_{c15/60}$ (W/lb.) | $P_{c17/60}$ (W/lb.) |
|---|---|---|---|---|---|---|---|
| 3524 | 0.51 | 0 | 0.15 | 19.6 | .92 | 0.61 | 0.76 |
| SB87 | 1.17 | 0 | 0.20 | 18.9 | .90 | 0.57 | 0.76 |
| 3523 | 0.04 | 0.60 | 0.29 | 19.3 | .91 | 0.81 | 1.06 |
| SB78 | 0.01 | 1.20 | 0.23 | 19.0 | .89 | 0.69 | 0.91 |
| SB134 | 0.58 | 0.30 | 0.19 | 19.6 | .92 | 0.61 | 0.76 |
| SB82 | 0.28 | 0.60 | 0.18 | 19.7 | .93 | 0.62 | 0.77 |
| SB128 | 1.15 | 0.60 | 0.21 | 18.9 | .90 | 0.56 | 0.77 |

Table 2 shows the analysis of the above compositions (the balance being essentially iron with incidental impurities).

TABLE 2

| Alloy No. | % Si | % Cr* | % Mn | % S | % C | % O |
|---|---|---|---|---|---|---|
| 3524 | 0.51 | 0 | 0.15 | 0.0032 | 0.008 | 0.0016 |
| SB87 | 1.17 | 0 | 0.12 | 0.0060 | 0.014 | 0.0021 |
| 3523 | 0.04 | 0.60 | 0.12 | 0.0024 | 0.022 | 0.019 |
| SB78 | 0.01 | 1.20 | 0.13 | 0.0047 | 0.013 | 0.0037 |
| SB134 | 0.58 | 0.30 | 0.14 | 0.0064 | 0.015 | 0.0027 |
| SB82 | 0.28 | 0.60 | 0.17 | 0.0055 | 0.014 | 0.0027 |
| SB128 | 1.15 | 0.60 | 0.14 | 0.0062 | 0.0006 | 0.0039 |

*Nominal

The $B_{10}/B_s$ ratio (the saturation flux density, $B_s$, was estimated from resistivity measurements) provides a good indication of the degree of orientation of a sample (a value of 1.0 representing perfect texture). While the above alloys were generally well textured, as indicated by their high $B_{10}$ values and $B_{10}/B_s$ ratios, the 17 kG losses were not as low as desired and values below 0.76 watts per pound were not obtained. The losses were particularly high in alloys without silicon addition.

The magnetic properties summarized in Table 3, below, were measured on annealed 0.006 inch Epstein samples of alloys of the present invention. In addition to the silicon, chromium and manganese content described in Table 3, the ingot also had nominal contents of 0.005% sulfur, 0.015% carbon, and 0.003% oxygen.

TABLE 3

| Alloy No. | Nominal % Si | Nominal % Cr | Nominal % Mn | $H_c$ (Oe) | $B_{10}$ (kG) | $B_{10}/B_s$ | $P_{c15/60}$ (W/lb.) | $P_{c17/60}$ (W/lb.) |
|---|---|---|---|---|---|---|---|---|
| SB190 | 0.8 | 0.6 | 0.15 | 0.17 | 19.3 | .92 | 0.56 | 0.70 |
| SB191 | 0.8 | 0.6 | 0.05 | 0.16 | 19.3 | .92 | 0.53 | 0.68 |
| SB192 | 0.9 | 0.7 | 0.15 | 0.18 | 19.1 | .92 | 0.52 | 0.72 |
| SB193 | 0.9 | 0.6 | 0.05 | 0.15 | 19.5 | .93 | 0.52 | 0.67 |
| SB194 | 0.9 | 0.5 | 0.15 | 0.17 | 19.5 | .93 | 0.54 | 0.71 |
| SB195 | 0.8 | 0.7 | 0.05 | 0.15 | 19.5 | .93 | 0.54 | 0.68 |
| SB196 | 0.8 | 0.5 | 0.15 | 0.16 | 19.4 | .93 | 0.54 | 0.69 |
| SB197 | 0.7 | 0.7 | 0.05 | 0.15 | 19.6 | .93 | 0.54 | 0.68 |
| SB199 | 0.7 | 0.5 | 0.05 | 0.16 | 19.4 | .92 | 0.57 | 0.73 |
| SB201 | 0.8 | 0.6 | 0.10 | 0.16 | 19.3 | .92 | 0.54 | 0.70 |
| SB208 | 0.8 | 0.6 | 0.02 | 0.15 | 19.2 | .92 | 0.53 | 0.71 |

It can be seen that the alloys of Table 3 have not only consistently high $B_{10}$ values and $B_{10}/B_s$ ratios (indicating a consistently high degree of (110) [001] texture development) but also have lower 17 kG loss values.

Thus, it can be seen that loss values at 17 kG can be minimized by maintaing the critical, narrow ranges of 0.6–1.0% silicon and 0.4–0.8% chromium. Preferably the alloy contains about 0.8% silicon and 0.6% chromium.

The invention is not to be construed as limited to the particular forms described herein, since these are to be regarded as illustrative rather than restrictive. The invention is intended to cover all compositions which do not depart from the spirit and scope of the invention.

We claim:

1. An improved composition of primarily recrystallized low-alloy iron having improved magnetic characteristics having a major proportion of the grains exhibiting a (110) [001] texture and having a primary recrystallized microstructure, said alloy consisting essentially of 0.6–1.0% silicon, 0.4–0.8% chromium, up to 0.15% manganese, up to 0.001% carbon, up to 0.005% sulfur, up to about 0.01% oxygen, up to 3% cobalt, with the balance being essentially iron with incidental impurities.

2. The alloy of claim 1, wherein the silicon content is about 0.8% and the chromium content is about 0.6%, said alloy having core loss values at 17 kG of about 0.7 watts per pound or below.

* * * * *